US008468621B2

(12) United States Patent
Steers et al.

(10) Patent No.: US 8,468,621 B2
(45) Date of Patent: Jun. 25, 2013

(54) ADJUSTABLE FURNITURE PRODUCT WITH AUTOMATICALLY-INFLATING MATTRESS

(75) Inventors: Charles Steers, Carthage, MO (US); Niels Mossbeck, Carthage, MO (US); Justin Brunnert, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 493 days.

(21) Appl. No.: 12/862,115

(22) Filed: Aug. 24, 2010

(65) Prior Publication Data

US 2012/0047647 A1 Mar. 1, 2012

(51) Int. Cl.
*A47C 17/13* (2006.01)

(52) U.S. Cl.
USPC ..... 5/13; 5/17; 5/37.1; 5/41; 5/42; 5/47; 5/48; 5/706; 5/654; 5/655.3

(58) Field of Classification Search
USPC ..... 5/13, 17, 37.1, 41, 42, 42.1, 47, 48, 5/706, 654, 655.3
See application file for complete search history.

(56) References Cited

U.S. PATENT DOCUMENTS 4,067,073 A * 1/1978 Komarov ..... 5/13
4,169,295 A * 10/1979 Darling ..... 5/706
4,625,345 A * 12/1986 Wood ..... 5/13
4,694,515 A * 9/1987 Rogers, Jr. ..... 5/13
6,108,844 A * 8/2000 Kraft et al. ..... 5/732
6,138,299 A * 10/2000 Roma et al. ..... 5/37.1
6,161,231 A * 12/2000 Kraft et al. ..... 5/18.1
6,185,764 B1 * 2/2001 Merritt ..... 5/136
6,668,395 B1 * 12/2003 Chen ..... 5/47
7,383,596 B2 6/2008 James
7,591,028 B2 * 9/2009 Roma et al. ..... 5/37.1
7,945,974 B2 * 5/2011 Cabrera et al. ..... 5/47
2009/0183308 A1 * 7/2009 Roma et al. ..... 5/37.1

* cited by examiner

*Primary Examiner* — Robert G Santos
*Assistant Examiner* — Ifeolu Adeboyejo
(74) *Attorney, Agent, or Firm* — Shook, Hardy & Bacon L.L.P.

(57) ABSTRACT

A furniture product includes a folding mechanism that folds into a seat frame. The folding mechanism includes a rear section, a middle section, and a front section, with the rear and middle sections being received in a cavity in the back of the seat frame when the product is in a stowed, seating position. Upon receiving a user input, a position motor deploys the folding mechanism into a sleeping position. Upon achieving the sleeping position, an inflation switch is engaged. An air pump disposed in or near the furniture product is activated in response to engagement of the inflation switch. To return the product to a stowed, seating position, a user input causes the air pump to deflate the mattress and the position motor to fold the folding mechanism into the seat frame.

15 Claims, 14 Drawing Sheets

ADJUSTABLE FURNITURE PRODUCT WITH AUTOMATICALLY-INFLATING MATTRESS

BACKGROUND

Traditional sofa sleepers are designed to be used as both a sofa and a bed. The sofa sleepers are designed with a folding frame mechanism that allows the mattress to be used as the support for the user when the unit is used as a sofa as well as a bed. Specifically, the mattress rests upon a support surface and the support surface can be moved from a sofa configuration to a sleeping configuration by pulling on the front of the folding mechanism. The traditional mattress used on these sofa sleepers is a four-inch mattress, which can be folded with the support surface for storage. In some cases, the traditional mattress is accompanied by an inflatable mattress for additional comfort and support. Typically, such folding mechanisms and mattress(es) are heavy to operate and, in any case, require the user to physically lift, pull, and/or push the folding mechanism into place, attach an air pump to an inflatable portion of the mattress, and inflate the mattress.

SUMMARY

This summary is provided to introduce a selection of concepts in a simplified form that are further described below in the Detailed Description. This summary is not intended to identify key features or essential features of the claimed subject matter, nor is it intended to be used, in isolation, as an aid in determining the scope of the claimed subject matter.

A first illustrative embodiment of the present invention relates to an apparatus that facilitates operation of a furniture product. Embodiments of the illustrative apparatus include a base frame including a laterally-oriented back member and a pair of parallel, opposed side members, each side member laterally extending from an end of the back member. A folding mechanism is moveably coupled to the base frame. The folding mechanism has a frame, a support surface, and a rolling support. The frame includes a rear section pivotably coupled between the side members, a middle section pivotably coupled to a front portion of the rear section, and a front section pivotably coupled to a front portion of the middle section. In embodiments, the illustrative apparatus can further include a mattress disposed on the support surface, wherein at least a portion of the mattress is inflatable. A motor is included that adjusts the folding mechanism between a first position and a second position; and an air pump is connected to at least a portion of the mattress such that the air pump inflates the portion of the mattress upon being activated.

A second illustrative embodiment of the present invention relates to an apparatus that facilitates operation of a furniture product. According to embodiments of the invention, the apparatus includes a base frame including a laterally-oriented back member and a pair of parallel, opposed side members, each side member laterally extending from an end of the back member. A folding mechanism is moveably coupled to the base frame. The folding mechanism includes a frame, a support surface, and a rolling support. The frame includes a rear section pivotably coupled between the side members, a middle section pivotably coupled to a front portion of the rear section, and a front section pivotably coupled to a front portion of the middle section. In embodiments, the apparatus further includes a mattress disposed on said support surface, wherein at least a portion of said mattress is inflatable. This embodiment also includes a motor that adjusts the folding mechanism between a first position and a second position. In the first position, an air pump, which is connected to at least a portion of the mattress, inflates the portion of the mattress upon being activated. According to an embodiment, the apparatus can also include an inflation switch disposed between the front section and the middle section that, when engaged, causes activation of the air pump.

A third illustrative embodiment of the present invention relates to a method for operating a motorized furniture product. In embodiments, the illustrative method includes receiving a user input and activating a position motor disposed within the furniture product. The position motor extends the folding mechanism until the folding mechanism is in a second position. The method further includes receiving an indication that an inflation switch disposed between two sections of the folding mechanism has been engaged. In response to receiving that indication, the method continues with activating an air pump disposed within the furniture product to inflate the mattress. In embodiments, the illustrative method further includes determining that the mattress is inflated and stopping the air pump in response to determining that the mattress is inflated.

These and other aspects of the invention will become apparent to one of ordinary skill in the art upon a reading of the following description, drawings, and the claims.

BRIEF DESCRIPTION OF THE DRAWINGS

The present invention is described in detail below with reference to the attached drawing figures, wherein.

DETAILED DESCRIPTION

The subject matter of the present technology is described with specificity herein to meet statutory requirements. However, the description itself is not intended to define the technology, which is what the claims do. Rather, the claimed subject matter might be embodied in other ways to include different components, steps, or combinations of components or steps similar to the ones described in this document, in conjunction with other technologies. Moreover, although the term "step" or other generic term might be used herein to connote different components or methods employed, the terms should not be interpreted as implying any particular order among or between various steps herein disclosed unless and except when the order of individual steps is explicitly described.

Figure 1:
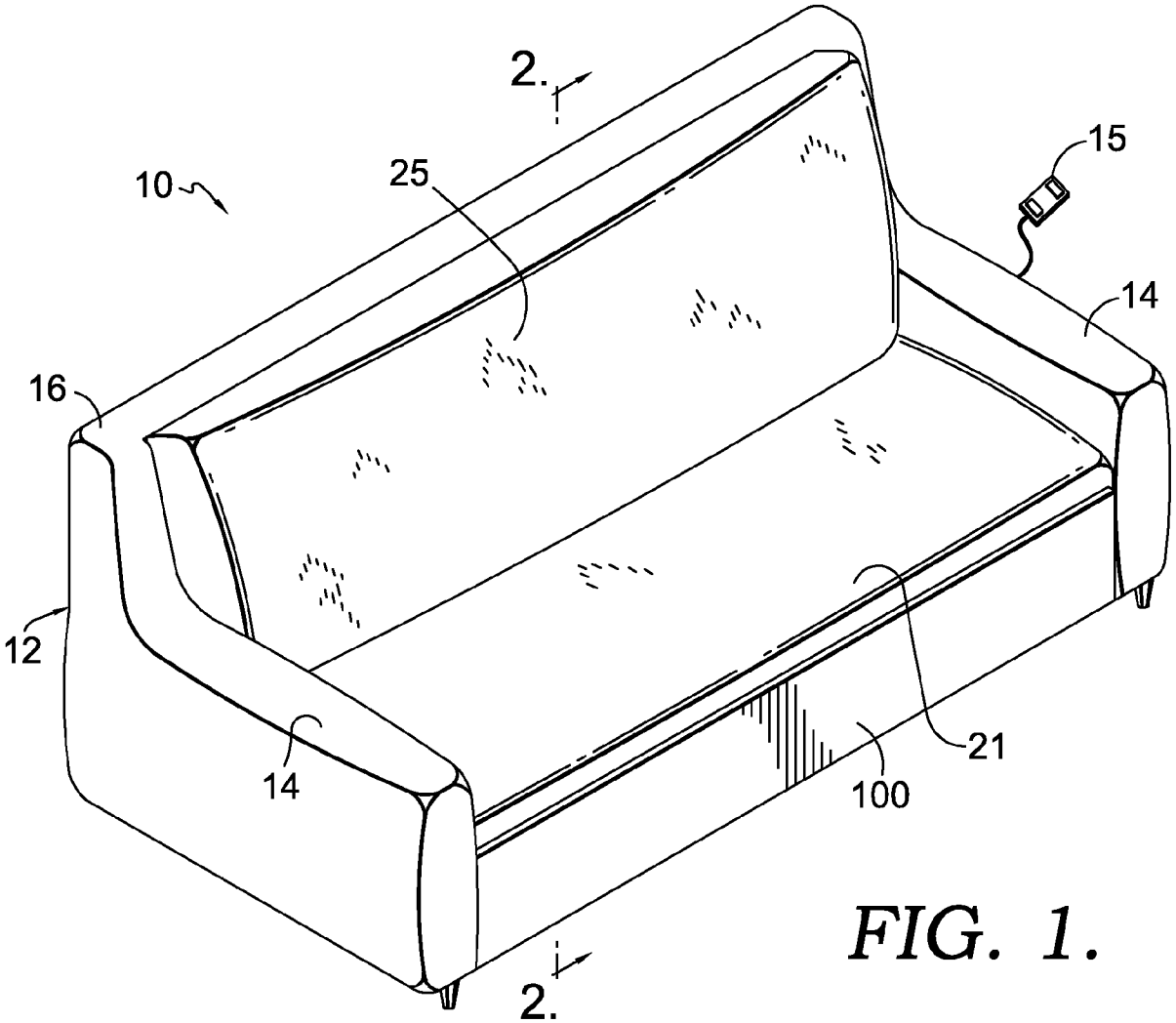
FIG. 1 is a perspective view of a furniture product in accordance with an embodiment of the present invention.
Figure 2:
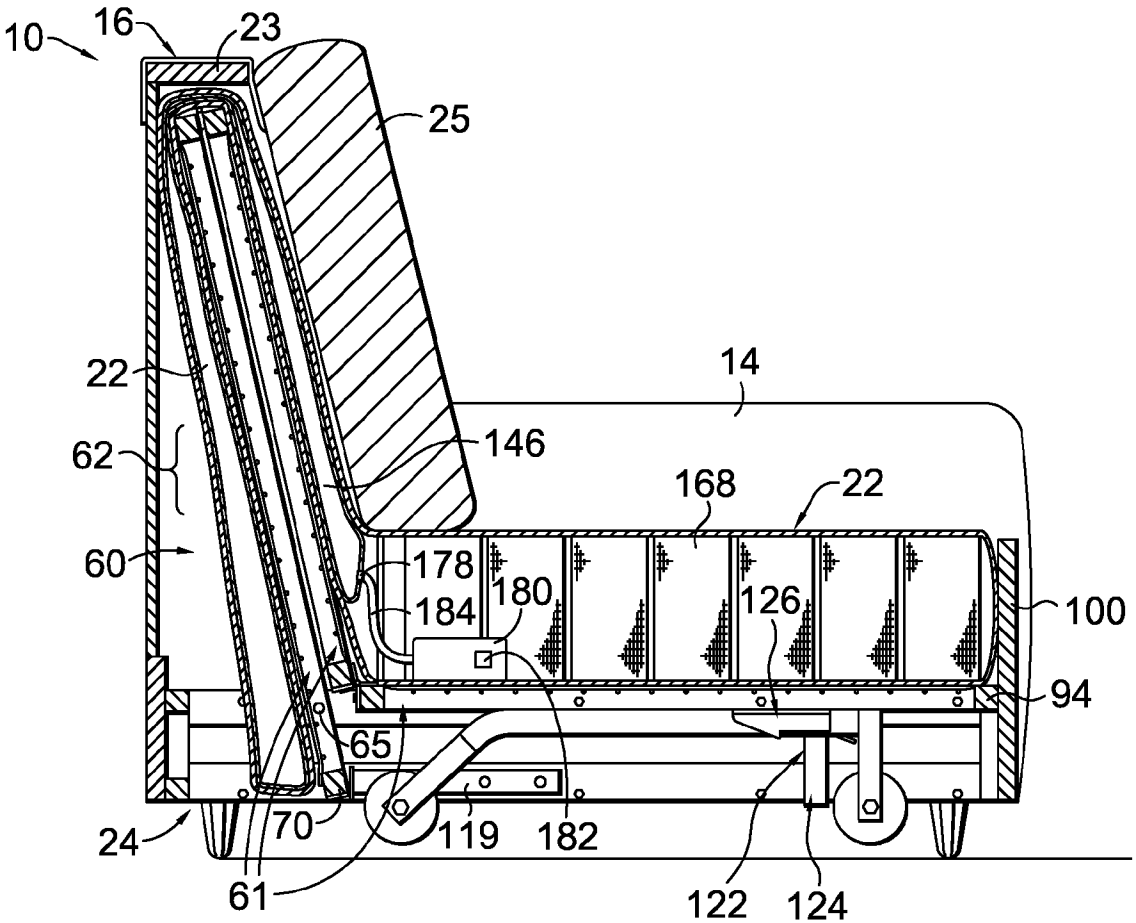
FIG. 2 is a side sectional view of a furniture product taken along line 2-2 in FIG. 1, in accordance with an embodiment of the present invention.
Figure 3:
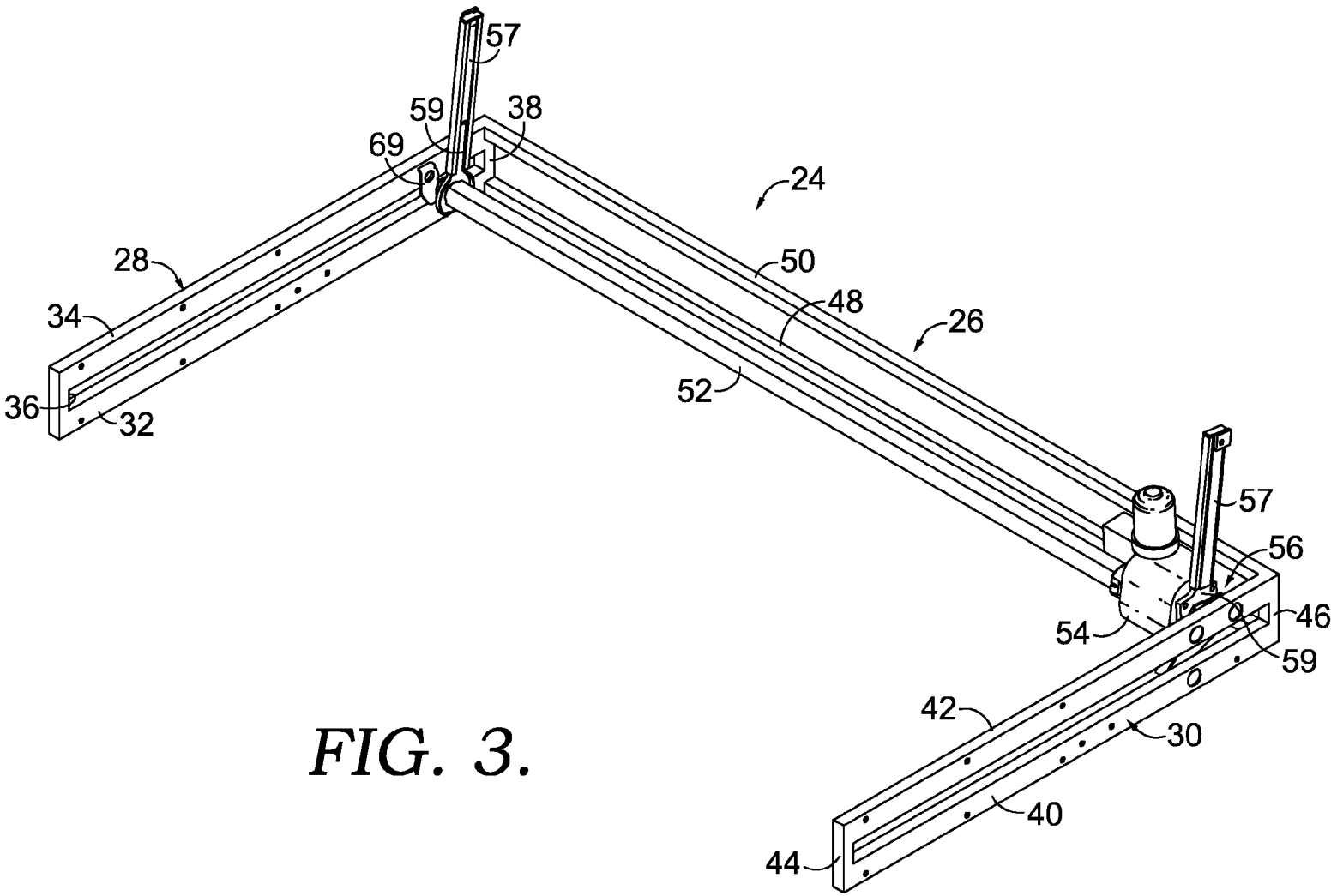
FIG. 3 is a perspective view of a base frame of a furniture product in accordance with an embodiment of the present invention.

With initial reference to FIGS. 1-3, a furniture product according to the principles of the present invention is designated generally with the reference numeral 10. Throughout this disclosure, the furniture product 10 is described as a seating structure that can be converted to a sleeping structure (e.g., a bed). The seating structure is intended to encompass sofas, chairs, love seats and other seating structures. The furniture product 10 can be converted from a stowed, seat position, shown in FIGS. 1-3 to a deployed, sleeping position, shown in FIG. 5. As shown in FIG. 1, the furniture product 10 includes a seat frame 12 having a pair of opposed arms 14 extending laterally from opposite ends of a back 16. In embodiments, the seat frame 12 defines a seat such as, for example, a sofa, a chair, a loveseat, or the like. A front mattress portion 21 is disposed between the arms 14 for supporting a user when seated. As explained further below, and shown in FIGS. 2, 4, and 5, the front mattress portion 21 is a portion of a mattress 22 that serves as a sleep support that supports a user in a sleeping position.

Figure 6:
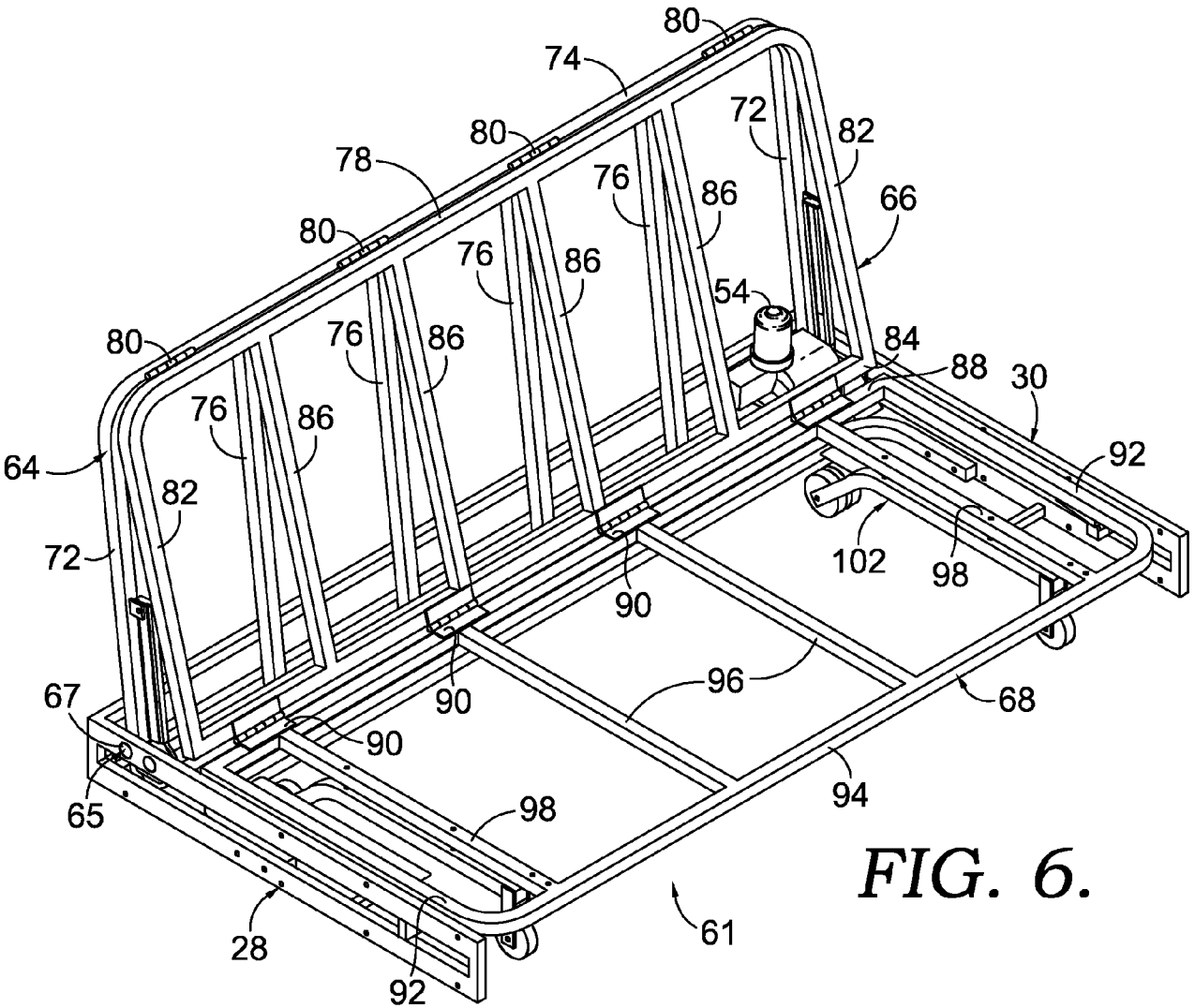
FIG. 6 is a perspective view of a furniture product frame in accordance with an embodiment of the present invention.

Both the arms 14 and the back 16 can, in embodiments, be upholstered in a traditional manner. As seen in FIGS. 1, 2, and 6, the furniture product 10, when in the stowed, seating configuration, contains a back and cushion 25 that supports the user when seated. Further, the mattress 22 also supports the user when seated, as will be further discussed below. The back cushion 25 may be coupled to an upper surface 23 of the back 16 or may be a loose cushion design. As such, the back cushion 25 can be rotated upwardly and out of the way when the furniture product 10 is converted from the stowed, seating position to the deployed, sleeping position. As illustrated in FIG. 1, the furniture product 10 also includes an input device 15 adapted for receiving input from a user to automatically adjust the furniture product 10 between a stowed, seating position and a deployed, sleeping position.

Figure 4:
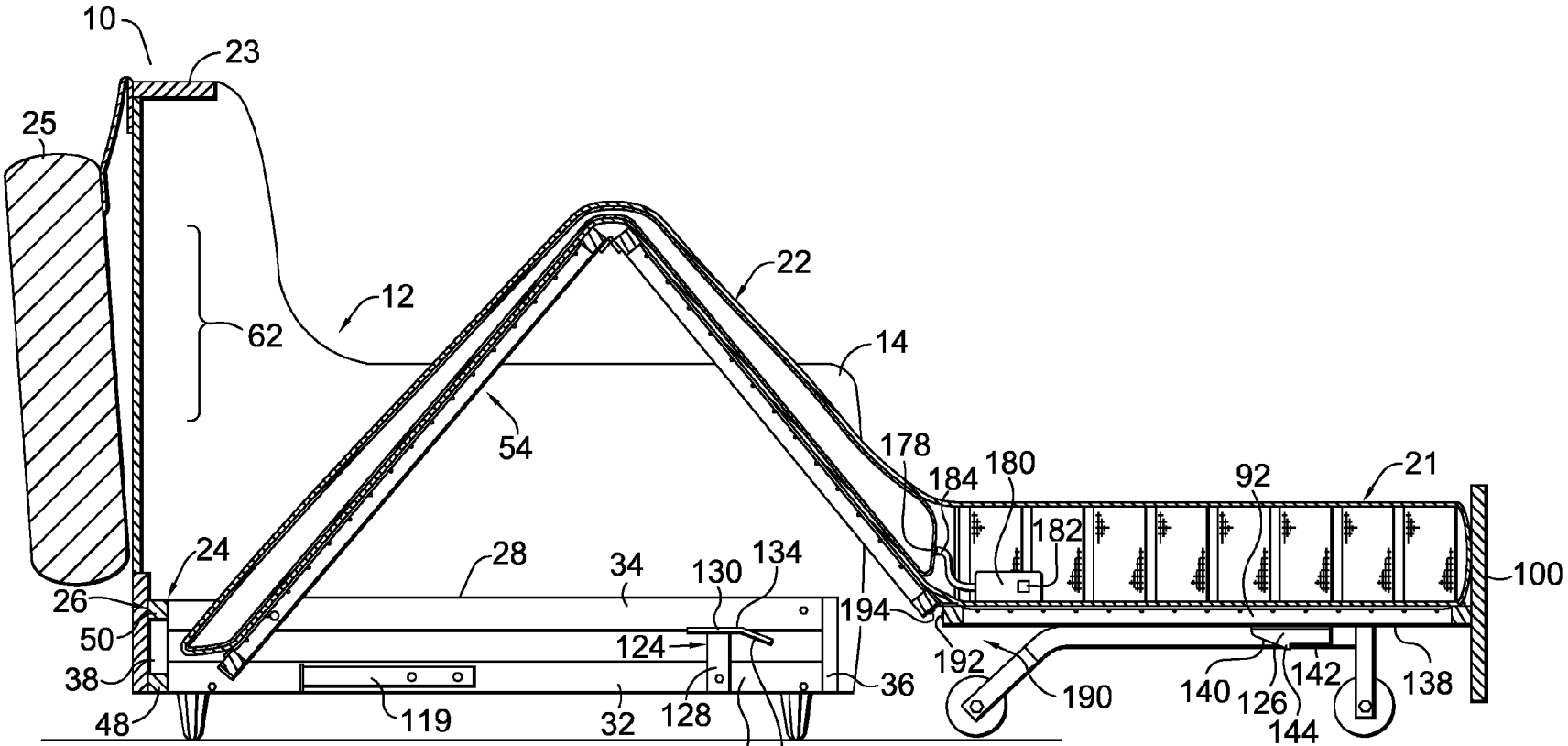
FIG. 4 is a side sectional view of a furniture product similar to the furniture product illustrated in FIG. 2 in accordance with an embodiment of the present invention, shown in a partially extended position.

As illustrated in FIGS. 2-4, the furniture product 10 further includes a base frame 24. For example, with particular reference to FIGS. 1-3, the base frame 24 includes a back member 26 that extends along a bottom portion of the back 16 between the arms 14. A pair of parallel, opposed side members 28 and 30 extend laterally away from opposite ends of the back member 26 and are generally orthogonal to the back member 26. The side members 28 and 30 are coupled to the arms 14 of the seat frame 12. In embodiments, as illustrated, side member 28 includes a lower portion 32, an upper portion 34, a front portion 36 extending vertically between a front end of the lower portion 32 and a front end of the upper portion 34, and a rear portion 38 extending vertically between a rear end of the lower portion 32 and a rear end of the upper portion 34 to define a generally rectangular side member 28.

Similarly, as illustrated in FIG. 3, side member 30 includes a lower portion 40, an upper portion 42, a front portion 44 extending vertically between a front end of the lower portion 40 and a front end of the upper portion 42, and a rear portion 46 extending vertically between a rear end of the lower portion 40 and a rear end of the upper portion 42 to define a generally rectangular side member 30. Similarly, as is further illustrated in FIG. 3, the back member 26 includes a lower portion 48 that extends between rear ends of the lower portions 32 and 40 of the side members 28 and 30 and an upper portion 50 that extends between rear ends of the upper portions 34 and 42 of the side members 28 and 30. Together with the rear portions 38 and 46 of the side members 34 and 24, the lower 48 and upper 50 portions of the back member 26 define a generally rectangular back member 26.

In some embodiments, side members 28 and 30 and back member 26 can be configured in any number of other ways as well. For example, in some embodiments, members 26, 28, and/or 30 can be solid pieces. In other embodiments, members 26, 28, and/or 30 can be implemented as solid pieces with appropriate apertures and slots cut therein to allow for various mechanical features such as those described below. Additionally, as illustrated in FIGS. 2, 4, 5, and 7, the furniture product 10 includes a support bracket 119 that extends between the side members 28 and 30 for providing additional support to the base frame 12.

As is further illustrated in FIG. 3, a torque rod 52 extends between the side members 28 and 30 in a position near the rear ends of the side members 28 and 30. As illustrated in FIG. 3, a position motor 54 is coupled to the torque rod 52 near one side of the torque rod 52. In embodiments, as shown in FIG. 9, the torque rod 52 passes through a receiving channel 58 defined within the position motor 54. The torque rod 52 is attached to the rear section 64 of the folding mechanism 60 via brackets 67. The position motor 54 actuates a folding mechanism 60 to adjust the folding mechanism 60 between the stowed, seating position, illustrated in FIGS. 2 and 6, and the deployed, sleeping position, illustrated in FIGS. 5 and 8. In embodiments, the position motor 54 can be a planetary gear motor such as, for example, a mosys-Classic motor, available from Hettich Franke GmbH & Co. KG, of Germany. In other embodiments, any suitable type of motor can be used to drive the folding mechanism 60.

As shown in FIGS. 3 and 9, the position motor 54 is mounted on the torque rod 52, which passes through a lower portion of the position motor 54. A receiving channel 58 disposed in the position motor 54 receives the torque rod 52. The position motor 54 is coupled to a rear section 64 of the folding mechanism 60 using a lever-arm mount 57. A lever arm 59 is coupled to the position motor 54 and is slidably received within a channel 61 defined within the lever-arm mount 57. The lever arm 59 is rotatably coupled to a motor-mounting bracket 63, which is attached to the side member 30. As the motor 54 rotates around an axis defined by the length of the torque rod 52, the motor 54 turns the torque rod 52, which in turn causes the lever arm 59 to rotate in a forward (e.g., clockwise, when viewed from the left) direction, sliding along the channel 61 in the lever-arm mount 57. This action causes the rear section 64 of the folding mechanism 60 to rotate in a clockwise direction, thereby driving the deployment operation. As illustrated in FIG. 3, a lever arm 59 and lever-arm mount 57 are also disposed at the end of the torque rod 52 opposite the end to which the position motor 54 is secured. The torque rod 52 rotates within a mounting bracket 69 secured to the side member 28.

Figure 7:
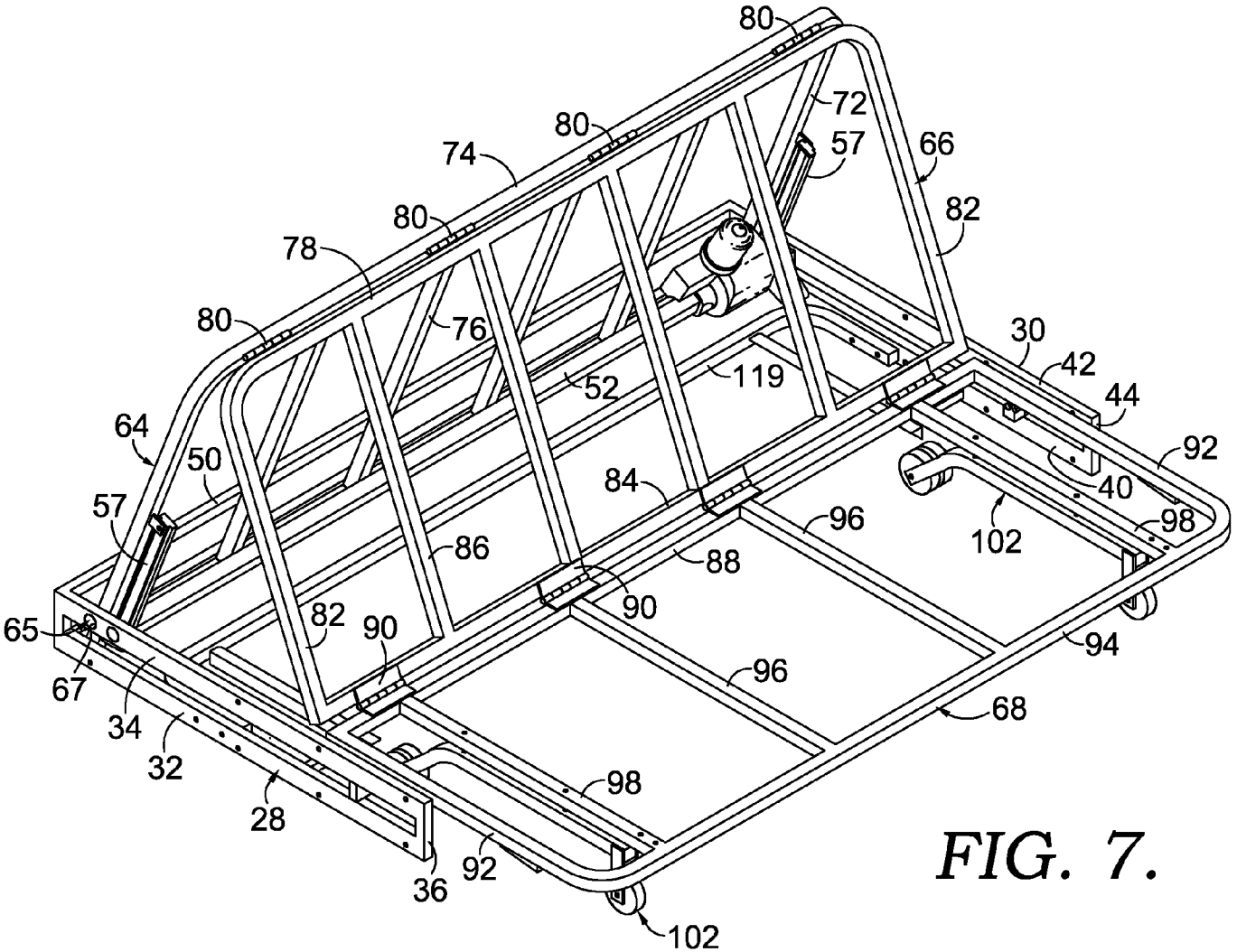
FIG. 7 is a perspective view of a furniture product frame in accordance with an embodiment of the present invention, shown in a partially extended position.
Figure 8:
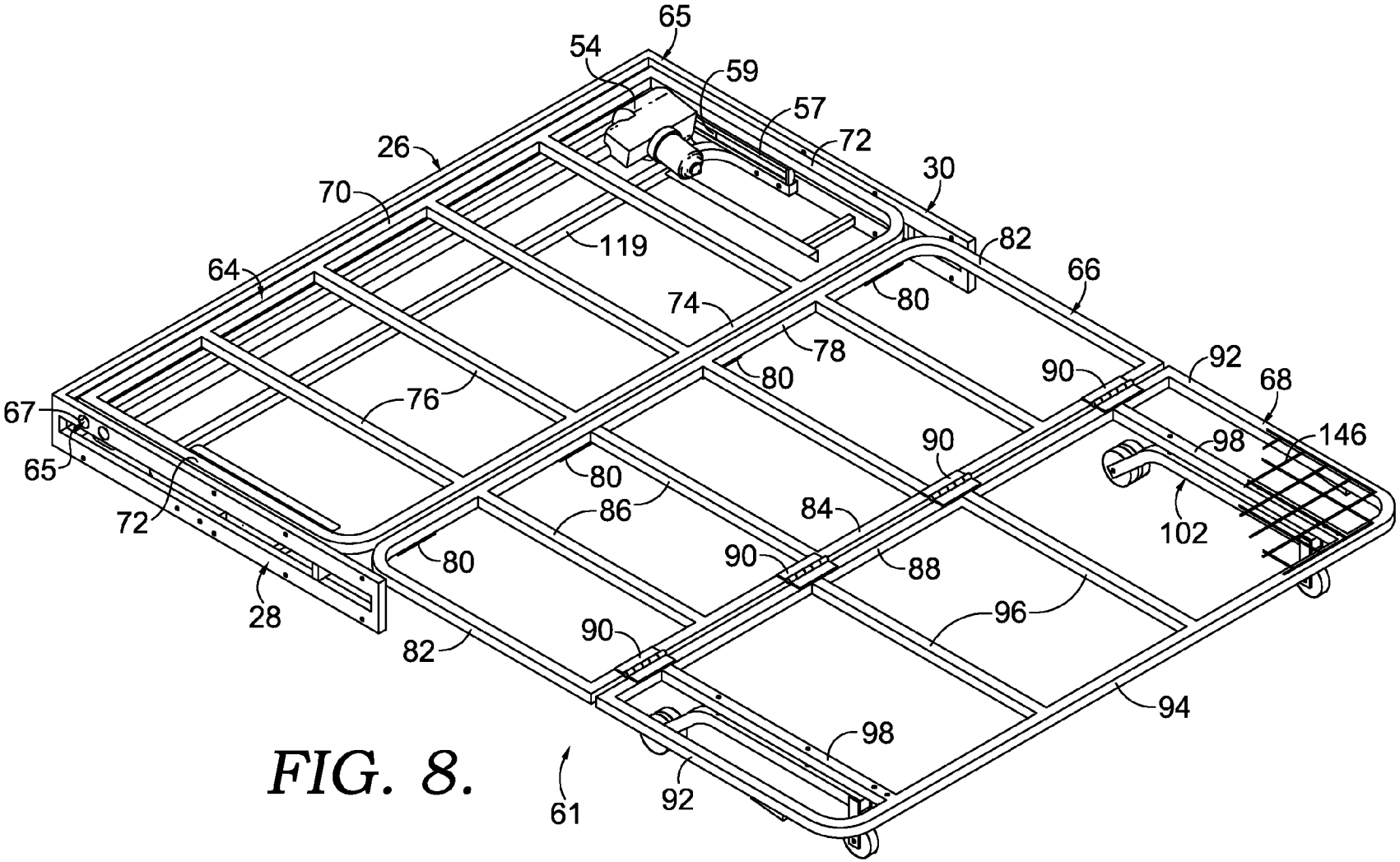
FIG. 8 is a perspective view of a furniture product frame in accordance with an embodiment of the present invention, shown in a fully extended position.
Figure 9:
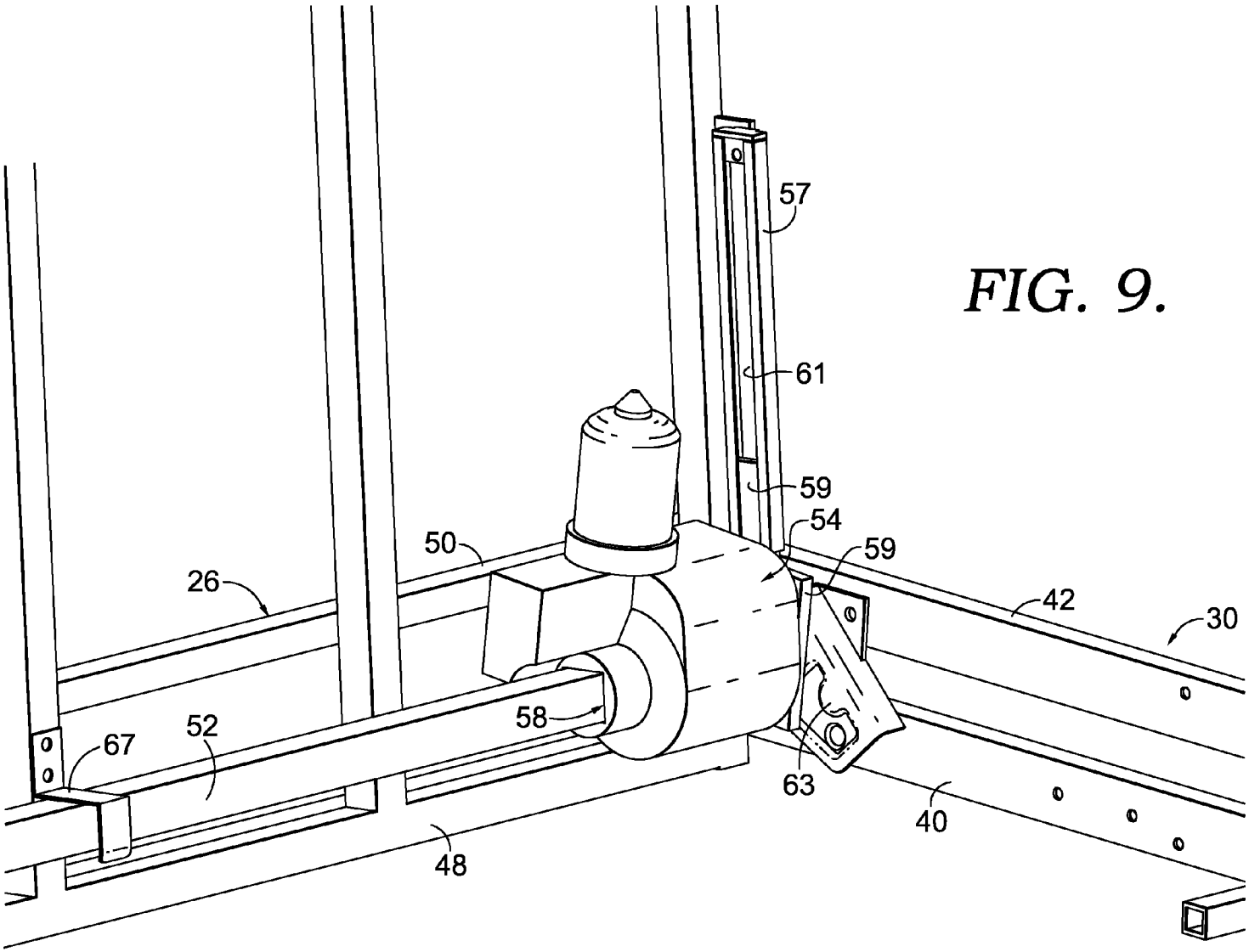
FIG. 9 is an enlarged perspective view of a portion of a furniture product, similar to the illustration of FIG. 3, in accordance with an embodiment of the present invention, shown in a stowed position.
Figure 10B:
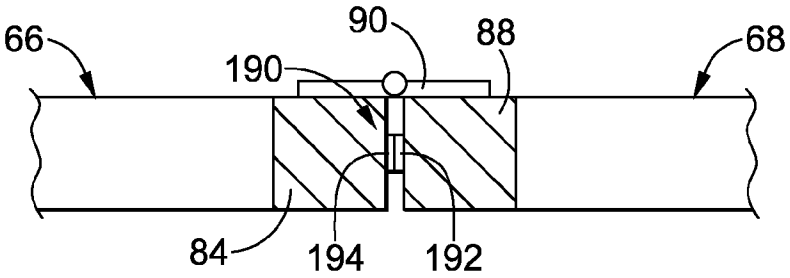
FIGS. 10A and 10B are side sectional views of a portion of a furniture product in accordance with an embodiment of the present invention.
Figure 10A:
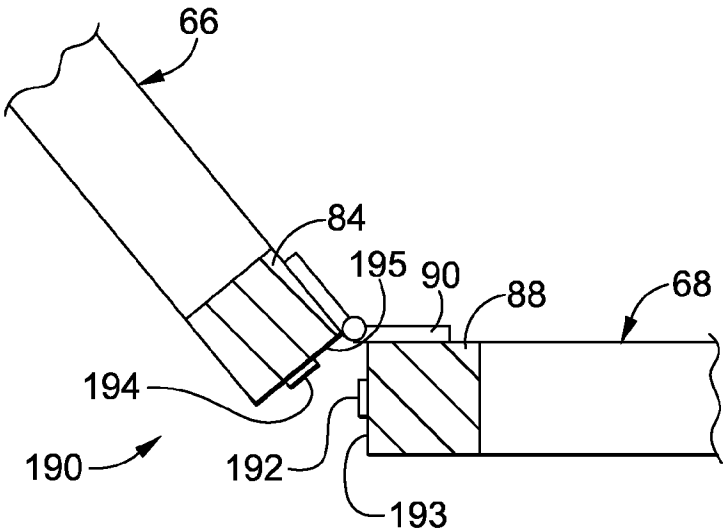
Figure 11:
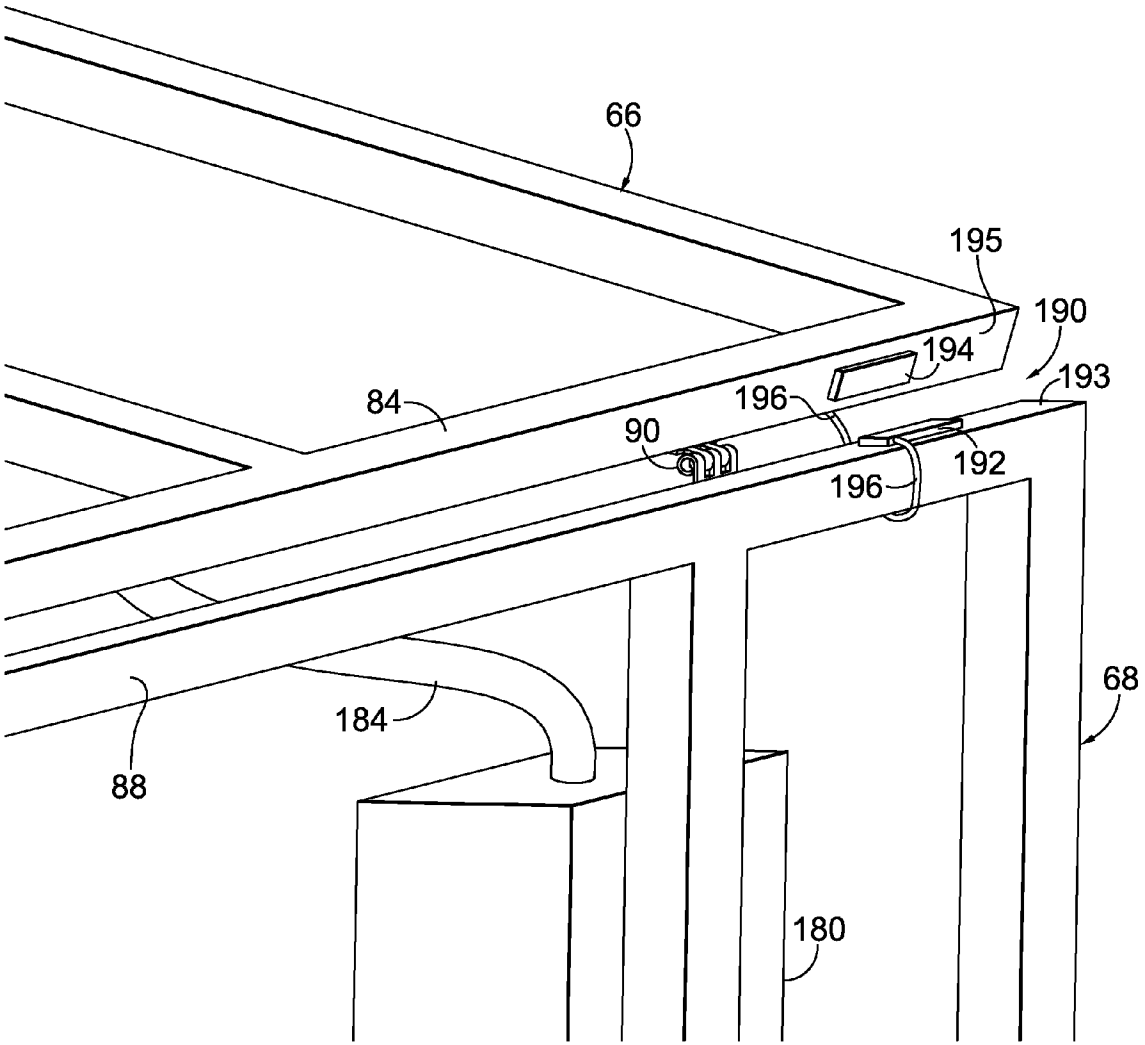
FIG. 11 is an enlarged perspective view of the underside of a portion of a furniture product frame in accordance with an embodiment of the present invention, shown in a partially extended position.

Referring now to FIGS. 6-8, the folding mechanism 60 will be described in further detail. As shown in FIGS. 2 and 4, the back 16 contains a cavity 62 that houses a portion of the folding mechanism 60 and mattress 22 when the furniture product is in the seating configuration. The folding mechanism 60 is coupled to the side members 28 and 30 of the base frame 24 and unfolds from within the cavity 62. As illustrated, the folding mechanism 60 includes a frame 61. The frame 61 includes a rear section 64 that is rotatably coupled at pivots 65 to side members 28 and 30, a middle section 66 that is pivotably coupled to the rear section 64, and a front section 68 that is pivotably coupled to the middle section 66. In embodiments, the rear section 64, middle section 66, and front section 68 are constructed from steel tubing, L-shaped metal bars, or the like, and are shaped as shown. It will be appreciated by individuals having skill in the relevant arts that any suitable material may be used to construct the various portions of the furniture product 10.

With continued reference to FIGS. 6-8, the rear section 64 includes a rear portion 70 that extends between a pair of parallel, opposed side portions 72 that extend away from opposite ends of the rear portion 70. The side portions 72 are rotatably coupled to side member 28 and 30 at rear ends of the side portions 72 via pivots 65. In embodiments, pivots 65 can include any attachment mechanism suitable for allowing the side portions 72 of the rear section 64 to rotate about pivots 65. For example, in an embodiment, coupling occurs via a nut and bolt arrangement (not illustrated) that engages apertures 67 in both the side portions 72 of the rear section 64. However, it should be understood that any suitable coupling method may be used. The rear section 64 also includes a front portion 74 that is generally parallel to the rear portion 70 and that extends between forward ends of the side portions 72. The rear, side, and front portions 70, 72, and 74 can be separate attached pieces or can be aspects of a solid structure. The rear section 64 further includes a plurality of cross members 76 that extend between the rear and front portions 70 and 74 and that are spaced apart to provide support.

The front portion 74 of the rear section 64 is pivotably coupled to a rear portion 78 of the middle section 66 by a plurality of hinges 80. The middle section 66 further includes a pair of parallel, opposed side portions 82 that extend away from opposite ends of the rear portion 78. The middle section 66 also includes a front portion 84 that is generally parallel to the rear portion 78 and that extends between forward ends of the side portions 82. The rear, side, and front portions 78, 82, and 84 can be separate attached pieces or can be aspects of a solid structure. The middle section 66 further includes a plurality of cross members 86 that are coupled between the rear and front portions 78 and 84 and are spaced apart to provide support. As seen in FIG. 8, in some embodiments, the cross members 76 and 86 of the rear and middle sections 64 and 66, respectively, are aligned with one another.

The front portion 84 of the middle section 66 is pivotably coupled to a rear portion 88 of the front section 68 by a plurality of hinges 90. The front section 68 further includes a pair of parallel, opposed side portions 92 that extend away from opposite ends of the rear portion 88. The front section 68 also includes a front portion 94 that is generally parallel to the rear portion 88 and that extends between forward ends of the side portions 92. The rear, side, and front portions 88, 92, and 94 can be separate attached pieces or can be aspects of a solid structure. The front section 68 further includes a pair of inner cross members 96 and a pair of outer cross members 98 that are coupled between the rear and front portions 88 and 94 and that are spaced apart to provide support. As illustrated in FIGS. 1, 2, 4, and 5, the front section 68 further includes a front foot portion 100 that is coupled to the front portion 94 and that extends between the arms 14.

Figure 5:
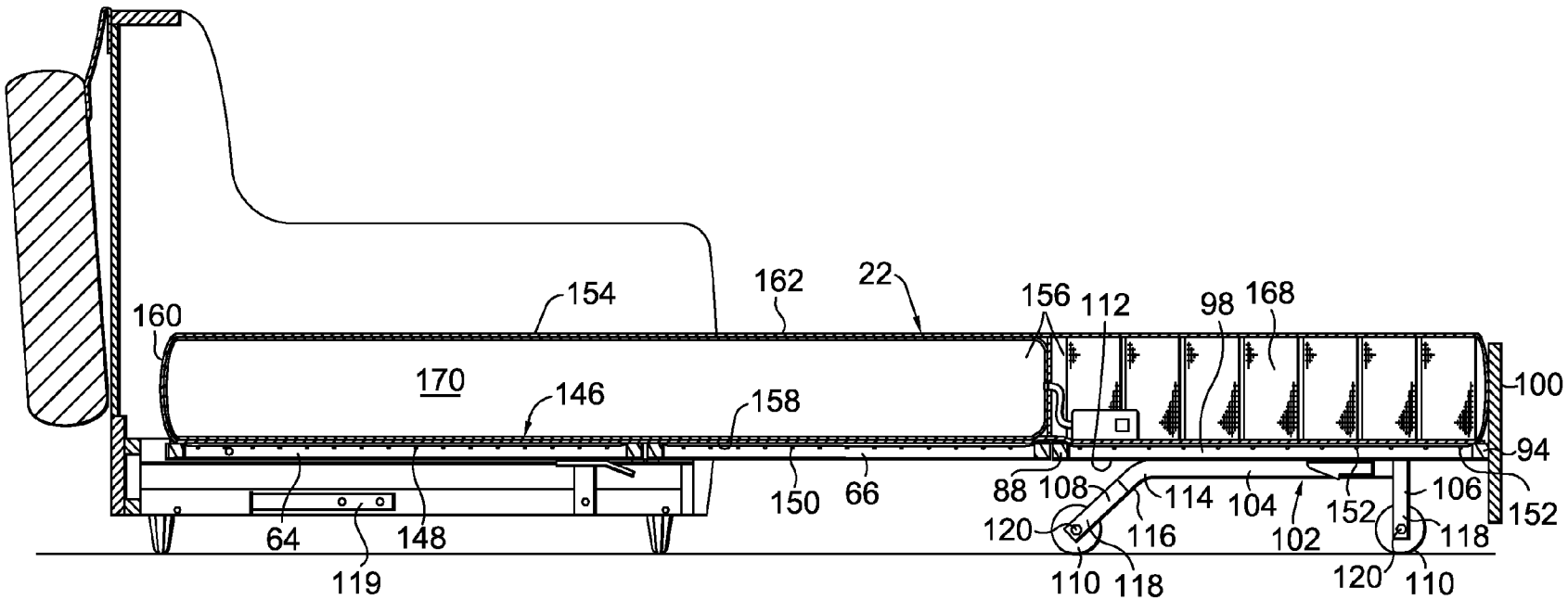
FIG. 5 is a side view of a furniture product similar to the furniture product illustrated in FIG. 4 in accordance with an embodiment of the present invention, shown in a fully extended position.

As seen in FIGS. 4-8, the folding mechanism 60 further includes a pair of rolling supports 102. The rolling supports 102 are coupled to each of the outer cross members 98. With particular reference to FIG. 5, each rolling support 102 includes an arm 104, a front fork 106, a rear fork 108, and a pair of wheels 110. The arm 104 is coupled with a lower surface 112 of the outer cross members 98. The arm 104 is shaped as shown and contains a downward bend 114 near the rear portion 88 of the front section 68. The arm 104 also contains an end 116 with the rear fork 108 attached thereto. The rear fork 108 contains a pair of legs 118 with the wheel 110 coupled therebetween. Each of the legs 118 contain an aperture 120 for attaching the wheel 110. The front fork 106 is mounted vertically near the front portion 94 of the front section 68 and abuts the arm 104.

Referring now to FIGS. 2, 4, and 5, the furniture product 10 includes a lock assembly 122. The lock assembly 122 includes a pair of brackets 124 and a pair of latches 126. The brackets 124 each contain a leg 128 and a riser 130. The leg 128 of each lock assembly 122 is coupled to a front portion 132 of the lower member 32 or 40 of the side portion 28 or 30 of the base frame 24. The legs 128 are oriented vertically. The riser 130 contains an upper portion 134 and a ramp 136. The upper portion 134 is oriented generally horizontally and the ramp 136 depends downwardly at an angle from the front of the upper portion 134.

The latches 126 are coupled to an underside 138 of the side portions 92 of the front section 68 intermediate the front and rear portions 94 and 88. The latches 126 depend downwardly from the side portions 92. The latch 126 is shaped as shown and contains a mating surface 140 and a rest surface 142. The mating surface 140 is an angled surface that contacts the ramp 136 of the riser 130 when the furniture product 10 is moved from the deployed, sleeping position to the stowed, seating position. The rest surface 142 is a horizontal surface and a portion of the mating surface 140 projects above the rest surface 142 to create a stop 144. The stop 144 locks the folding mechanism 60 in place when the furniture product 10 is moved from the deployed, sleeping position to the stowed, seating position. Specifically, the stop 144 contacts the rear of the upper portion 134 of the riser 130.

Turning now to FIGS. 5 and 8, the furniture product 10 includes a support surface 146 upon which the mattress 22 is disposed. The support surface 146 includes a rear portion 148, a middle portion 150, and a front portion 152. In embodiments, each of the rear, middle, and front portions 148, 150, 152 are constructed of a wire grid that is coupled to the rear, middle, and front sections 64, 66, and 68 of the folding mechanism 60. In other embodiments, the support surface 146 can be constructed of fabric, elastomeric textile, or the like.

Figure 12:
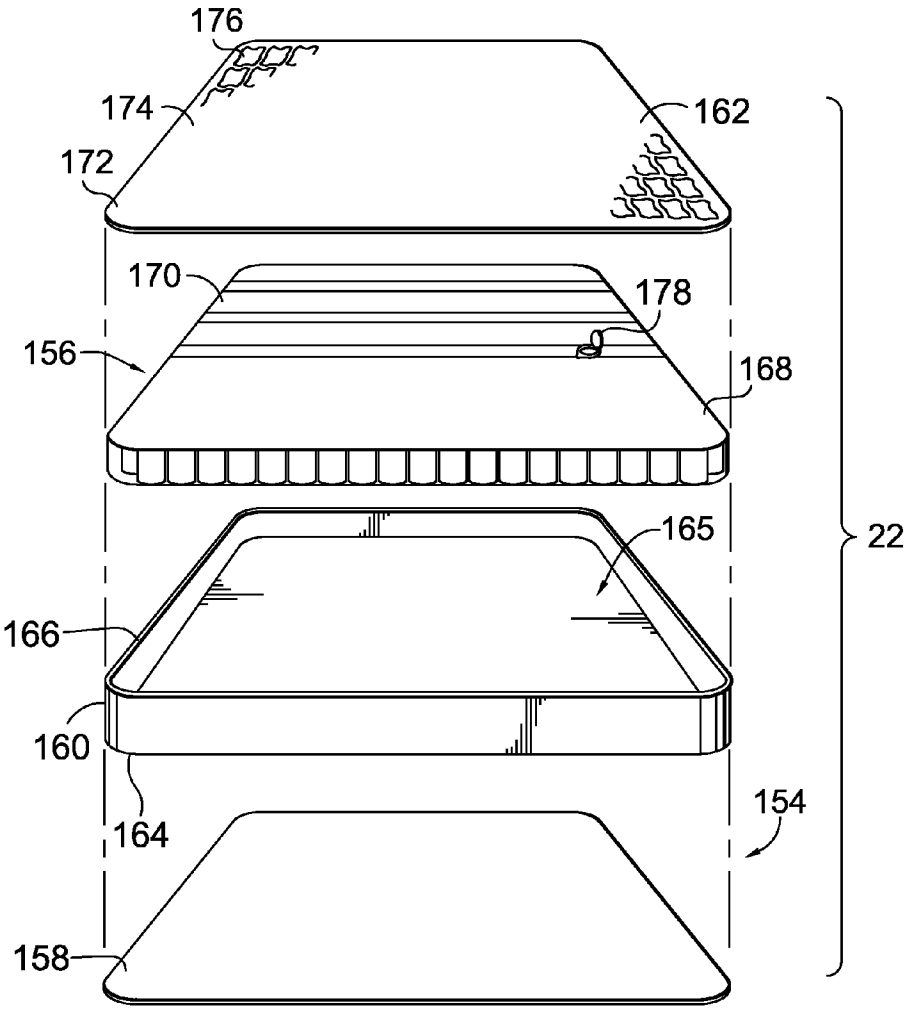
FIG. 12 is an exploded perspective view of a mattress in accordance with an embodiment of the present invention.

Referring now to FIG. 12, the mattress 22 includes a shell 154 and an inner support 156. The shell 154 includes a lower panel 158, a sidewall 160, and a cover 162. The lower panel 158 rests on the support surface 146. The sidewall 160 contains a lower edge 164 and an upper edge 166. The sidewall 160 is attached on its lower edge 164 to the lower panel 158 and extends around its perimeter. The cover 162 is attached to the upper edge 166 of the sidewall 160. As is understood by one of ordinary skill in the art, the shell 154 consisting of the lower panel 158, the sidewall 160, and the cover 162 fit together to form a cavity 165 to receive the inner support 156. Further, it will be appreciated by one of ordinary skill in the art that any attachment method for the cover could be used, such as a zipper, stitching, sewing or the like. In one embodiment, the sidewall has a zipper, not shown, attached on its upper edge 166 that is used to removably couple the cover 162 to the sidewall 160. This embodiment provides a cover 162 that is removably attached so that the user has direct access to the inner support 156. In another embodiment, the cover 162 is attached to the upper edge 166 of the sidewall 160 by stitching or sewing.

With continued reference to FIG. 12, the inner support 156 is shown received within the shell 154. The inner support 156 broadly includes an innerspring portion 168 and an air bladder portion 170, both portions having a height comparable to a conventional sofa mattress. As is apparent to one of ordinary skill in the art, the mattress 22 further contains a foot end 172, a middle section 174, and a head end 176. The innerspring portion 168 is generally located at the foot end 172 of the mattress 22, and corresponds to the front mattress portion 21, while the air bladder portion 170 is located at the middle section 174 and head end 176. The air bladder portion 170 is sized to correspond to middle section 174 and head end 176 of the mattress 16 such that when the mattress 22 is folded for storage, the air bladder portion along with the rear and middle sections 64 and 68 of the folding mechanism 60 fit within the cavity 62 in the back 16.

As best seen in FIG. 5, the innerspring portion 168 abuts the air bladder portion 170 to form a continuous support surface for the user when the mattress 16 is in the deployed position. The innerspring portion 168 of the mattress 22 is any one of a number of existing innerspring configurations available and known to one of ordinary skill in the art. As an example, the innerspring portion 168 can be a pocketed coil.

The air bladder portion 170 can be made from a durable, air impermeable material, such as vinyl. The air bladder 170 may be one of a number of existing bladders currently available and known to one of ordinary skill in the art. The air bladder 170 includes a valve 178 that is integrally formed therein. The valve 178 is sized to accommodate an air pump 180 that may be either external or internal to the bladder. In either configuration, the air pump can contain a reversible deflation feature and/or a dump valve release system. In embodiments, the valve 178 is located near the innerspring portion 168 for convenient connection to an air pump 180 disposed within the innerspring portion 168. Additionally, it is also understood that the valve may extend through the shell for outside access if the cover and, thus, the shell are sealed.

In embodiments, as shown in FIGS. 2, 4, and 5, an air pump 180 can be disposed within the innerspring portion 168 of the mattress 22. The air pump 180 is connected to the air bladder 170 by an air tube 184 that extends from the air pump 180 and attaches to the valve 178 on the air bladder 170. In embodiments, the air pump 180 can be disposed in any number of other locations on or around furniture product 10 as well. As is illustrated in FIG. 4, the air pump 180 can include a pressure sensor 182. In embodiments, the pressure sensor 182 can be disposed within the air tube 184, at the valve 178, within the air bladder 170, or the like.

With reference to FIGS. 4, 10A, 10B, and 11, the air pump 180 can be activated in response to engagement of an inflation switch 190. The inflation switch 190 can be any type of suitable switch mechanism such as, for example, a proximity switch (e.g., a photo-eye, a magnetic system, a circuit, etc.), a button, or the like. In an embodiment, as shown, the inflation switch 190 can include a first portion 192 attached to a rear edge 193 of the rear portion 88 of the front section 68 of the folding mechanism 60. A second portion 194 of the switch 190 is attached to a front edge 195 of the front portion 84 of the middle section 66 of the folding mechanism 60. In this manner, when the folding mechanism is deployed, causing the middle 66 and front 68 sections of the folding mechanism 60 to move from the position shown in FIG. 10A to the position shown in FIG. 10B, the inflation switch is engaged.

In embodiments, the inflation switch 190 can be communicatively connected to the air pump, the position motor, or a control unit via a wire 196. In other embodiments, the inflation switch can be located at any number of other locations such as, for example, within the position motor 54, in the proximity of the lever arm 59, between the rear section 64 and the middle section 66, and the like. Additionally, in some embodiments, the inflation switch 190 includes only one portion 192 that may be, for instance, a button that is depressed upon engagement with the front edge 195 of the front portion 84 of the middle section 66. In embodiments, any other suitable arrangement can be implemented for integrating an inflation switch 190 within the furniture product 10.

The operation of the furniture product 10 will now be discussed. FIGS. 5 and 8 illustrate the furniture product 10 in the deployed, sleeping position, wherein the mattress 22 is useful as a sleeping surface. The air bladder portion 170 of the mattress 22 is inflated and the air bladder portion 170 and the innerspring portion 168 abut to provide a continuous support surface for the user. FIGS. 4 and 7 illustrate the furniture product 10 in the intermediate, folded position, wherein the mattress 22 is ready to be stored. The air bladder portion 170 of the mattress 22 is deflated. From this position, the folding mechanism 60 is pulled inwardly by the operation of the position motor 54 to fully stow the mattress 22. In the stowed, seating position, shown in FIG. 2, the stop 144 of the latch 126 is engaged with the rear of the riser 130. Further, the innerspring portion 168 of the mattress 22 provides a support for the seated user on the furniture product 10. Because, in embodiments, the innerspring portion 168 is shaped and sized similarly to the support portion of a traditional seat, the innerspring portion 168 provides a support closely resembling the feel of a traditional seat.

Referring again to FIGS. 1, 2 and 4, to place the furniture product 10 in a position for sleeping, the back cushion 25 is rotated upwardly and over the back 16 and the user utilizes an input device 15 to provide a user input to, for example, a control unit (e.g., by pressing a button). In response to the user input, the position motor 54 is activated to cause the adjustments discussed below. Upon activation, the position motor 54 rotates in a forward direction, causing the rear section 64 to rotate in a forward direction about the pivots 65. As the rear section rotates, this rotation causes the middle section 66 to pivot in a rearward direction with respect to the front section 68, which pushes the front section 68 forward. In embodiments, the position motor 54 pushes, in the manner described immediately above, the front section 68 forward with enough force to cause the front section 68 of the folding mechanism to move upwardly so that the stop 144 may disengage from the rear of the riser 130. Once the stop 144 is disengaged, the folding mechanism 60 is pushed from within the furniture product to the position shown in FIG. 4. It should be understood that the folding mechanism 60 unfolds as the position motor 54 rotates the rear section 64 of the folding mechanism 60, thereby moving the front foot portion 100 forward, away from the seat frame 12.

Specifically, the rear and middle sections 64 and 66 are pushed from within the cavity 62 in the back 16 of the furniture product 10 by the operation of the position motor 54. In the stowed, seating position the air bladder portion 170 is deflated. The position motor 54 causes the rear section 64 to rotate in a clockwise manner about the pivots 65. This rotation causes the middle section 66 to pivot in a counterclockwise direction about the front portion 74 of the rear section 64, which causes the front section 68 to move forward, away from the seat frame 12 until the front portion 74 of the rear section 64 aligns with the rear portion 78 of the middle section 66 and the front portion 84 of the middle section 66 aligns with the rear portion 88 of the front section 68, rendering the support surface 146 generally flat. The furniture product 10 is now in the deployed position as shown in FIG. 5. In this position, the inflation switch 190, which is disposed between the front portion 84 of the middle section 66 and the rear portion 88 of the front section 68 of the folding mechanism 60, is engaged. In embodiments, the inflation switch 190 is a proximity switch, and when the two portions of the inflation switch 190 are positioned next to each other, as a result of deployment of the folding mechanism 60, the inflation switch 190 is engaged.

Engagement of the inflation switch 190 causes the air pump 180 to activate and inflate the air bladder portion 170. In some embodiments, the air pump 180 continues to inflate the air bladder portion 170 until a desired pressure is reached. According to embodiments, the air pump 180 includes a pressure sensor 182 that detects the pressure in the air bladder portion 170 by measuring back-pressure in the air pump 180. In other embodiments, an air pressure sensor 182 can be disposed within the air bladder portion 170 or at any other position such as, for example, within the air tube 184 connecting the air pump 180 to the air bladder portion 170. In other embodiments, the air pump 180 continues to inflate the air bladder portion 170 for a predetermined amount of time (e.g., an amount of time sufficient to allow the air pump 180 to inflate the air bladder portion 170 to a desired level). Upon reaching a desired inflation level of the air bladder portion 170, the air pump 180 automatically deactivates.

When the mattress 22 is to be stowed within furniture product 10, the user provides input via the input device 15 that causes a stowing operation to be initiated. In embodiments, the stowing operation includes automatic activation of the air pump 180 in a reverse operation, whereby the air pump 180 deflates the air bladder portion 170. In some embodiments, the valve 178 is manually opened, allowing air to escape from the bladder 170. In some embodiments, the air pump continues to deflate the air bladder 170 until a predetermined amount of time has passed. After the predetermined amount of time has passed, the air pump 180 automatically deactivates. In some embodiments, the pressure sensor 182 can be used to determine when the air bladder 170 is fully deflated. Once the air is removed from the bladder 170, the position motor 54 is automatically activated, causing the folding mechanism 60 to retract into the stowed, seating position. In this manner, converting the furniture product 10 between the stowed, seating position and the deployed, sleeping position can be accomplished by a single press of a button, without requiring the user to physically pull out the folding mechanism, inflate the mattress, or the like.

Figure 13:
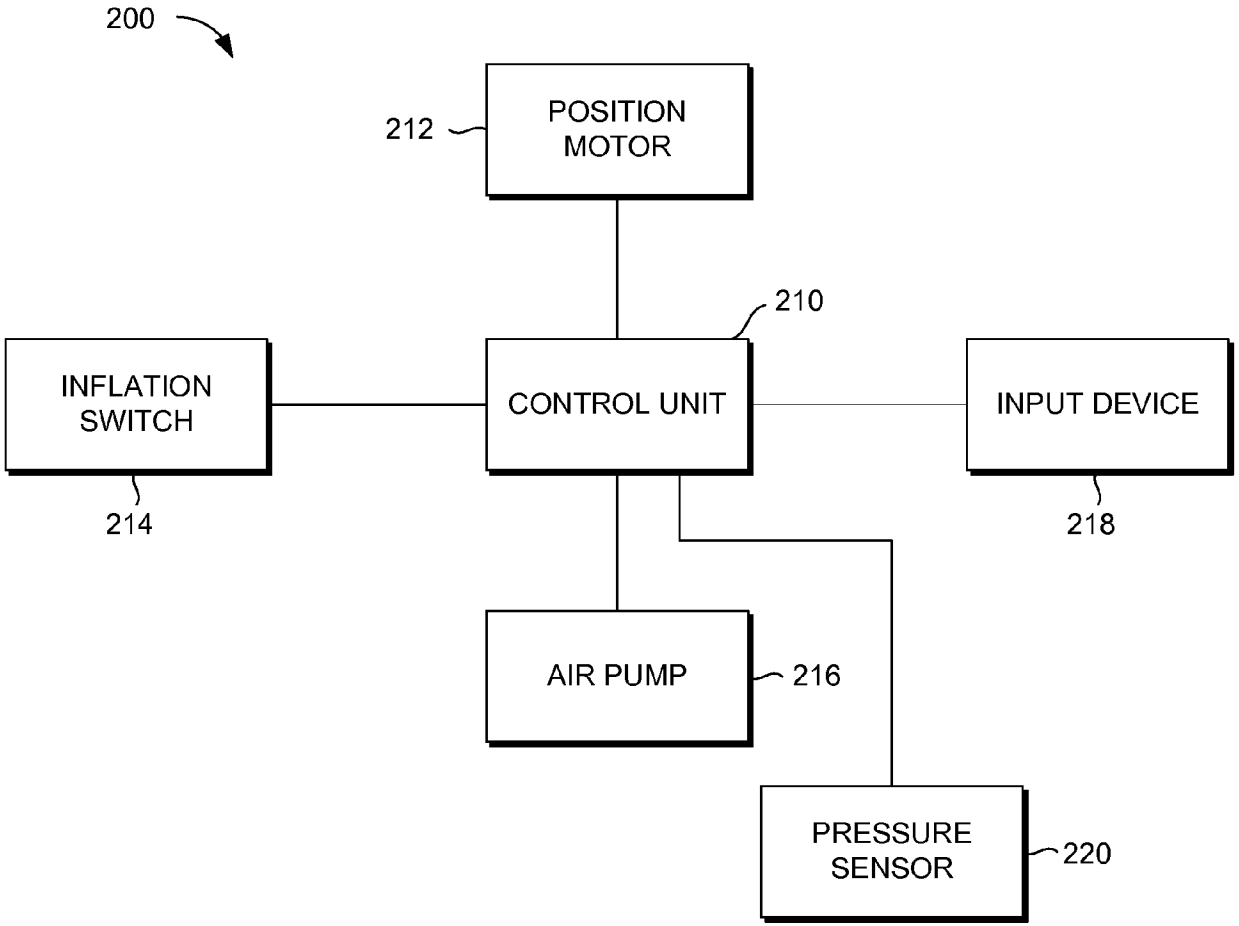
FIG. 13 is a block diagram depicting an illustrative operating environment for implementing automated features of a furniture product in accordance with an embodiment of the invention.

Turning to FIG. 13, an illustrative operating environment 200 adapted for accomplishing the automated features described above is depicted in a block diagram. The illustrative operating environment 200 includes a control unit 210, a position motor 212, an inflation switch 214, an air pump 216, an input device 218, and a pressure sensor 220. The position motor 212 is a position motor such as the position motor 54 described above, the inflation switch 214 is a switch such as the switch 190 described above, the air pump 216 is an air pump such as the air pump 180 described above, the input device 218 is an input device such as the input device 15 described above, and the pressure sensor 220 is a pressure sensor such as the pressure sensor 182 described above.

The exemplary operating environment 200 shown in FIG. 12 is an example of one suitable operating environment 200 and is not intended to suggest any limitation as to the scope of use or functionality of embodiments of the inventions disclosed throughout this document. Neither should the exemplary operating environment 200 be interpreted as having any dependency or requirement related to any single component or combination of components illustrated therein. For example, in some embodiments, the pressure sensor 220 can be integrated with the air pump 216, while, in other embodiments, the operating environment 200 does not include a pressure sensor 220.

Control unit 210 can be any type of suitable control unit adaptable for synchronizing and controlling operation of the various components 212, 214, 216, 218, and 220 of the operating environment 200. In some embodiments, for example, the control unit 210 includes one or more processors, solid-state elements, switches, and/or the like. In some embodiments, the control unit 210 can be a simple hub switch center for selecting distribution of inputs from the input device 218 or other components, while in other embodiments, the control unit 210 can include any desired level of intelligence, computation ability, and the like. In embodiments, input device 218 can be connected to the control unit via a wire or using wireless technology and can include, for example, a wand, a remote control, a keypad, or the like.

According to embodiments of the invention, the control unit 210 receives user input from input device 218 and interprets the inputs as commands to initiate a deployment operation. In response to the input, the control unit 210 causes the position motor 212 to deploy the folding mechanism (e.g., folding mechanism 60) into a deployed, sleeping position. Upon reaching the deployed position, the inflation switch 214 is engaged and sends a signal to the control unit 210. In response to receiving the signal, which is an indication that the inflation switch has been engaged, the control unit 210 sends a signal to the position motor 212 to cause the position motor to cease its operation. At substantially the same time, the control unit 210 activates the air pump 216, which begins inflating the air bladder of the mattress (e.g., air bladder 170). Once the air bladder is fully inflated (or inflated to a desired level), in some embodiments, the pressure sensor 220 provides an indication that inflation is complete to the control unit, which deactivates the air pump 216. In other embodiments, the control unit 210 deactivates the air pump after a predetermined amount of time.

Similarly, when the user wishes to return the furniture product to a stowed, seating position, the user provides an input via the input device 218, which is received by the control unit 210. In response to receiving the input, the control unit 210 activates the air pump 216 in a reverse operation, causing the air pump 216 to deflate the air bladder. In some embodiments, when the air bladder is completely deflated, the pressure sensor 220 provides an indication to the control unit 210 that deflation is complete, in response to which the control unit 210 deactivates the air pump 216. In other embodiments, the control unit 210 deactivates the air pump 216 after a predetermined amount of time. Once the air bladder is deflated and the air pump is deactivated, the control unit 210 activates the position motor 212, which moves the folding mechanism into the stowed, seating position. It should be understood that each of these operations—the deployment operation and the stowing operation—can be accomplished by a single user input.

Figure 14:
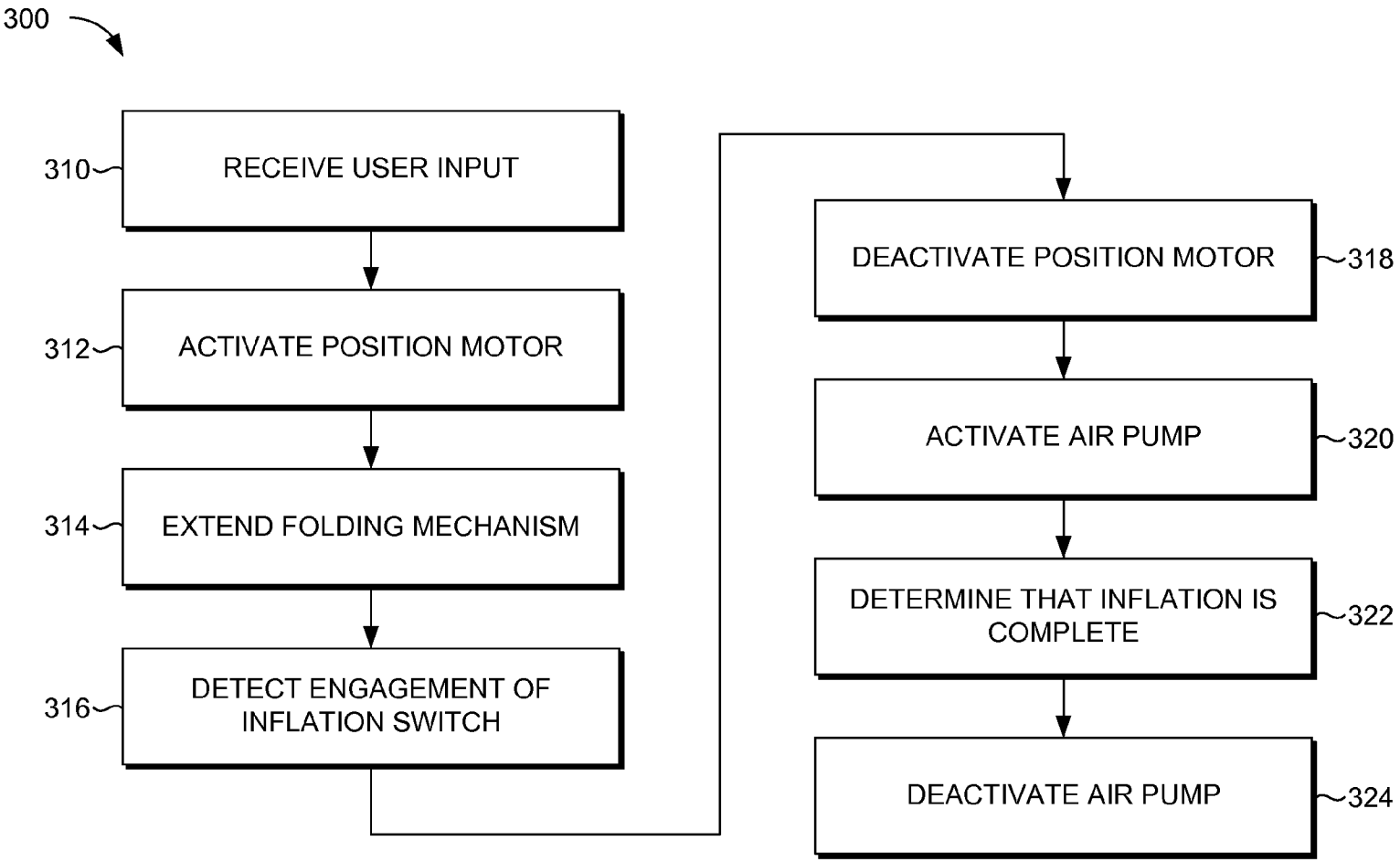
FIG. 14 is a flow diagram depicting an illustrative method of operating a furniture product in accordance with an embodiment of the present invention.

Turning now to FIG. 14, a flow diagram depicts an illustrative method 300 of operating a furniture product in accordance with embodiments of the invention. As shown in FIG. 14, the illustrative method 300 includes, at step 310, receiving user input. For the purposes of the present illustration, it will be assumed that the furniture product is initially in a stowed, seating position as described above. In embodiments, user input is received by an input device such as, for example, a wand, a remote control, a keypad, or the like. In some embodiments, a user can provide input, for example, by pressing a button, speaking a command, turning a knob, touching a touch-screen, or the like. In embodiments, the user input can be received by a control unit such as the control unit 210 described above. In other embodiments, the position motor can itself be or include a control unit such as, for example, where the position motor includes an interface or other technology for receiving and processing a user input.

As shown at step 312 in FIG. 14, the illustrative method further includes activating a position motor. The position motor is activated in response to receiving the user input. In embodiments, the position motor is activated directly and in other embodiments, the position motor is activated by a control unit. As shown at step 314, the position motor, once activated, extends the folding mechanism of the furniture product from the stowed, seating position to the deployed, sleeping position.

Upon reaching (or nearly reaching) the deployed, sleeping position, the control unit detects engagement of the inflation switch, as shown at step 316. In embodiments, the inflation switch can become engaged when two portions of the switch, each being attached to an adjacent section of the folding mechanism, are brought within close proximity to one another. In other embodiments, the inflation switch can be a button disposed on one edge of a section of the folding mechanism and that is depressed when brought into contact with an edge of an adjacent section of the folding mechanism (or with a contact structure disposed on the edge of the adjacent section of the folding mechanism).

At step, 318, the position motor is deactivated. In some embodiments, the position motor is deactivated automatically when the position motor has turned a certain distance. In other embodiments, the position motor is deactivated in response to the detection of the engagement of the inflation switch. Additionally, at step 320, the air pump is activated. In embodiments, the air pump can be activated in response to the position motor having turned a particular distance. In other embodiments, the air pump is activated in response to the detection of the engagement of the inflation switch. Upon activation of the air pump, the air pump inflates the air bladder.

At step 322, the control unit and/or air pump determines that inflation of the air bladder is complete. In an embodiment, this determination is made by receiving an indication from a pressure sensor that a desired air pressure within the bladder has been achieved. In other embodiments, the determination is made by determining that a particular amount of time has passed since activation of the air pump. At a final illustrative step, step 324, the air pump is deactivated and the furniture product is in its deployed, sleeping position. Although not illustrated, similar methods can be employed to return the furniture product to its stowed, seating position.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

What is claimed is:

1. An apparatus that facilitates operation of a furniture product, the apparatus comprising:

a base frame;

a folding mechanism moveably coupled to said base frame, said folding mechanism comprising a frame, a support surface, and a rolling support, said frame including a rear section pivotably coupled to said base frame, a middle section pivotably coupled to a front portion of the rear section, and a front section pivotably coupled to a front portion of the middle section;

a mattress disposed on said support surface, wherein at least a portion of said mattress is inflatable;

a motor coupled to said folding mechanism that adjusts the folding mechanism between a first position and a second position; and an air pump connected to said at least a portion of said mattress such that the air pump inflates said at least a portion of said mattress upon being activated;

an inflation switch positioned to indicate when the folding mechanism is in the second position, that, when engaged, causes activation of the air pump; wherein the inflation switch is fixed to said front edge of a front portion of the middle section such that, when the folding mechanism is in the second position, a rear edge of a rear portion of the front section makes contact with the switch, thereby engaging the switch.

2. The apparatus of claim 1, wherein the inflation switch is disposed between the middle section and the front section.

3. The apparatus of claim 1, further comprising a control unit that receives user input from an input device and activates the motor in response to receiving said input.

4. The apparatus of claim 3, wherein the control unit receives an indication of engagement of the inflation switch and activates the air pump in response to receiving said indication.

5. An apparatus that facilitates operation of a furniture product, the apparatus comprising:

a base frame including a laterally-oriented back member and a pair of parallel, opposed side members, each side member laterally extending from an end of said back member;

a folding mechanism moveably coupled to said base frame, said folding mechanism comprising a frame, a support surface, and a rolling support, said frame including a rear section pivotably coupled between said side members, a middle section pivotably coupled to a front portion of the rear section, and a front section pivotably coupled to a front portion of the middle section;

a mattress disposed on said support surface, wherein at least a portion of said mattress is inflatable;

a motor that adjusts the folding mechanism between a first position and a second position, wherein in the first position;

an air pump connected to said at least a portion of said mattress such that the air pump inflates said at least a portion of said mattress upon being activated; and an inflation switch disposed between said front section and said middle section that, when engaged, causes activation of the air pump;

wherein the inflation switch is fixed to a front edge of said front portion of the middle section such that, when the folding mechanism is in the second position, a rear edge of a rear portion of the front section makes contact with the switch, thereby engaging the switch.

6. The apparatus of claim 5, wherein the inflation switch is a proximity switch.

7. The apparatus of claim 5, further comprising a control unit that receives user input from an input device and activates the position motor in response to receiving said input.

8. The apparatus of claim 7, wherein the control unit receives an indication of engagement of the inflation switch and activates the air pump in response to receiving said indication.

9. The apparatus of claim 7, wherein the input device is a remote control.

10. The apparatus of claim 8, further comprising a pressure sensor that provides an indication to the control unit that a desired level of air pressure in the at least a portion of said mattress.

11. A method for operating a furniture product, the furniture product comprising a folding mechanism moveably coupled to a base frame, said folding mechanism comprising a frame, a support surface, and a rolling support, said frame including a rear section pivotably coupled between a pair of side members, a middle section pivotably coupled to a front portion of the rear section, and a front section pivotably coupled to a front portion of the middle section, the furniture product also including a mattress disposed on said support surface, wherein at least a portion of said mattress is inflatable, the method comprising:

receiving a user input, the user input comprising a command to adjust the folding mechanism from a first position to a second position;

activating a position motor disposed within the furniture product, wherein the position motor extends the folding mechanism until the folding mechanism is in the second position;

receiving an indication that an inflation switch disposed between two sections of the folding mechanism has been engaged;

activating an air pump disposed within the furniture product in response to receiving said indication, wherein the air pump inflates the mattress;

determining that the mattress is inflated; and stopping the air pump in response to determining that the mattress is inflated;

wherein the inflation switch is fixed to a front edge of said front portion of the middle section such that, when the folding mechanism is in the second position, a rear edge of a rear portion of the front section makes contact with the switch, thereby engaging the switch.

12. The method of claim 11, wherein said user input is achieved by way of a single action taken by the user.

13. The method of claim 12, wherein said single action includes the user pressing a button disposed on an input device.

14. The system of claim 11, wherein determining that the mattress is inflated includes determining that a predetermined amount of time has passed since the air pump was activated.

15. The system of claim 11, wherein determining that the mattress is inflated includes determining that the air inside the mattress has a pressure that is greater than or equal to a threshold pressure.

* * * * *